US009727018B2

(12) United States Patent
Ide

(10) Patent No.: US 9,727,018 B2
(45) Date of Patent: Aug. 8, 2017

(54) METHOD OF PREPARING TONER IMAGE PRINTED MATERIAL AND DEVICE FOR PREPARING TONER IMAGE PRINTED MATERIAL

(71) Applicant: FUJI XEROX CO., LTD., Tokyo (JP)

(72) Inventor: Osamu Ide, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/054,813

(22) Filed: Feb. 26, 2016

(65) Prior Publication Data

US 2017/0090390 A1 Mar. 30, 2017

(30) Foreign Application Priority Data

Sep. 25, 2015 (JP) ..... 2015-188837

(51) Int. Cl.
*G03G 15/00* (2006.01)

(52) U.S. Cl.
CPC ..... *G03G 15/6582* (2013.01)

(58) Field of Classification Search
CPC ..... G03G 2215/00421
See application file for complete search history.

(56) References Cited

U.S. PATENT DOCUMENTS

2005/0227159 A1 10/2005 Matsuoka et al.
2008/0230941 A1* 9/2008 Williamson ..... B44C 1/1729 264/135
2011/0223527 A1* 9/2011 Iio ..... G03G 8/00 430/105

FOREIGN PATENT DOCUMENTS

JP 3897758 B2 3/2007
JP 3897863 B2 3/2007
JP 4299197 B2 7/2009

* cited by examiner

*Primary Examiner* — Hoa V Le
(74) *Attorney, Agent, or Firm* — Oliff PLC

(57) ABSTRACT

A method of preparing a toner image printed material includes forming a toner image on a recording medium; forming a coating film by applying a coating liquid to a surface having the toner image of the recording medium; and drying the coating film, wherein the toner image contains, as a binder resin, a polyester resin having a hydroxyl value of 25 mgKOH/g or higher, and the coating liquid contains a solvent component that swells or dissolves the polyester resin, a polyisocyanate component, and a polyol component.

8 Claims, 1 Drawing Sheet

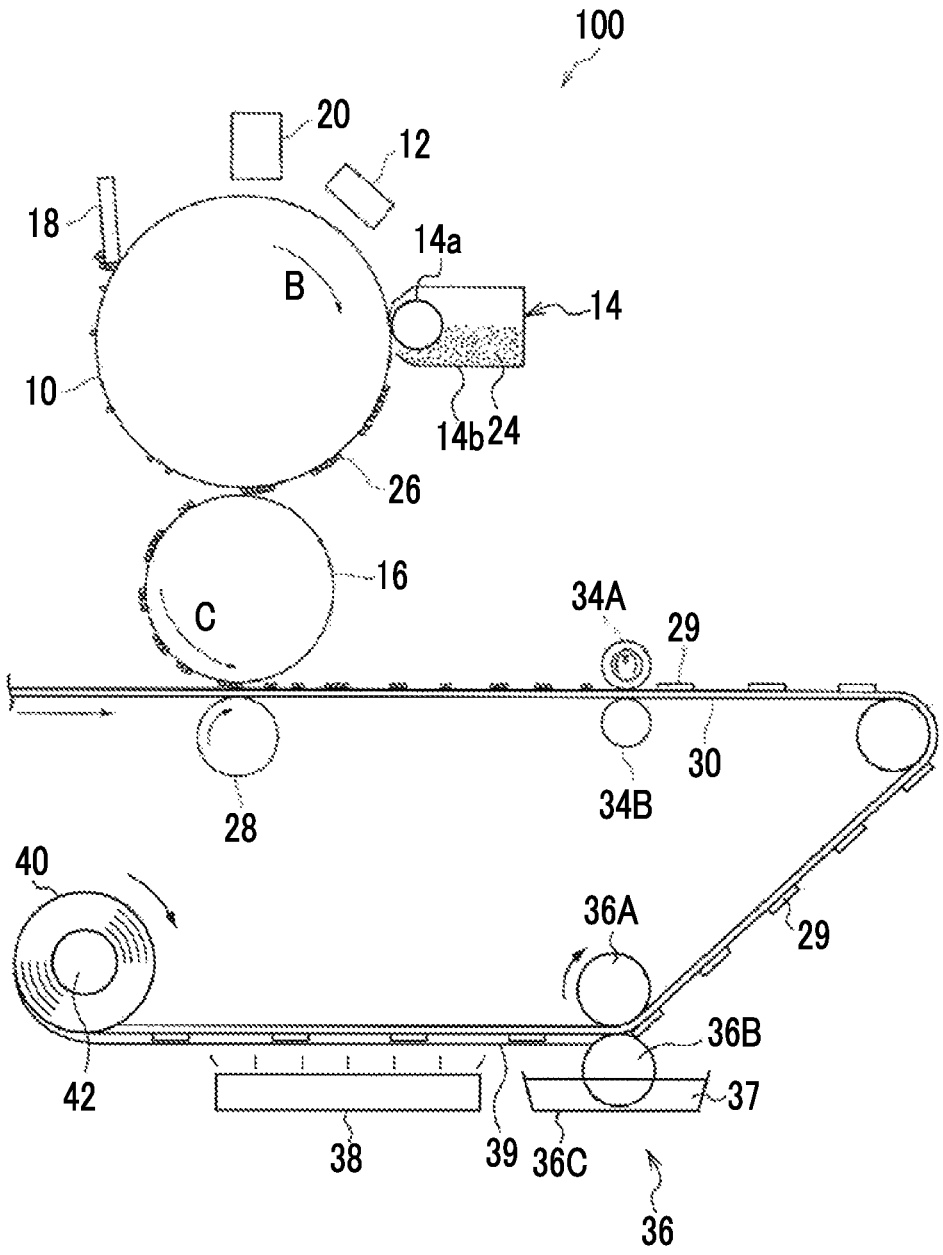
100
20
12
18
14a
B
14
10
14b
24
26
16
C
34A
29
30
34B
28
40
36A
29
36B
42
37
38
39
36C
36

METHOD OF PREPARING TONER IMAGE PRINTED MATERIAL AND DEVICE FOR PREPARING TONER IMAGE PRINTED MATERIAL

CROSS-REFERENCE TO RELATED APPLICATIONS

This application is based on and claims priority under 35 USC 119 from Japanese Patent Application No. 2015-188837 filed Sep. 25, 2015.

BACKGROUND

1. Technical Field

The present invention relates to a method of preparing a toner image printed material and a device for preparing a toner image printed material.

2. Related Art

When a toner image is formed on a surface of a recording medium according to an electrophotographic system, an unfixed toner image formed on the recording medium is fixed by a fixing device. As the recording medium, a thermoplastic resin film for a soft package material may also be used other than paper.

Various technologies are proposed to improve the adhesion of a toner image with respect to a recording medium.

SUMMARY

According to an aspect of the invention, there is provided a method of preparing a toner image printed material including:

forming a toner image on a recording medium;

forming a coating film by applying a coating liquid onto a surface having the toner image of the recording medium; and drying the coating film, wherein the toner image contains, as a binder resin, a polyester resin having a hydroxyl value of 25 mgKOH/g or higher, and the coating liquid contains a solvent component that swells or dissolves the polyester resin, a polyisocyanate component, and a polyol component.

BRIEF DESCRIPTION OF THE DRAWINGS

Exemplary embodiments of the present invention will be described in detail based on the following figures, wherein:

FIG. 1 is a schematic diagram illustrating an example of a configuration of a device for preparing a toner image printed material according to an exemplary embodiment.

DETAILED DESCRIPTION

Hereinafter, a method of preparing a toner image printed material and a device for preparing a toner image printed material according to an exemplary embodiment will be described in detail with reference to the accompanying drawing.

Method of Preparing Toner Image Printed Material

A method of preparing a toner image printed material according to this exemplary embodiment includes an image forming process of forming a toner image on a recording medium with a toner including toner particles containing, as a binder resin, a polyester resin (hereinafter, may be referred to as "high-hydroxyl-value polyester resin") having a hydroxyl value of 25 mgKOH/g or higher, a coating process of forming a coating film by applying a coating liquid containing a polyisocyanate component, a polyol component, and a solvent component which swells or dissolves the polyester resin to a surface having the toner image thereon of the recording medium (hereinafter, may be referred to as "toner image surface"), and a drying process of drying the coating film.

When a toner image formed on a surface of an electrophotographic photoreceptor in an electrophotographic manner is transferred to a recording medium and fixed by heating and pressurization, it is difficult to keep a balance between toner fluidity and fixing strength (adhesive strength) in a fixing process.

For example, when a resin film such as polyethylene terephthalate (PET) or biaxially stretched nylon (ONY) is used as the recording medium, the toner image has lower adhesive properties (peeling strength) than in a case of using paper, and thus it is difficult for the toner image to obtain sufficient adhesive properties even when a corona treatment or a plasma treatment is performed on the surface of the resin film.

For example, when a toner image (hereinafter, may be simply referred to as "image") is formed on a thermoplastic resin film for a soft package material, the thermoplastic resin film in a wound state is drawn out, the toner image is formed on the thermoplastic resin film, and the thermoplastic resin film is wound again. Thereafter, this film is drawn out in a sticking process, and a coating liquid for adhering the image surface to a sticking base is applied to the image surface, and then subjected to a drying process to stack and laminate the sticking base by applying heat and a pressure. Therefore, in the process of applying the coating liquid to the toner image formed on the thermoplastic resin film and drying the coating liquid, a phenomenon in which the toner image dissolved by the coating liquid is transferred to a member such as a roll coming into contact with the image surface or the coating liquid surface, e.g., a coating roll and a feed roll up until the drying process (in this description, the phenomenon in which the toner partially adheres to an unintended member may be referred to as "toner offset") may occur.

In addition, when a thermoplastic resin film is used as the recording medium, the thermoplastic resin film is easy to deform when a fixing temperature is high. Accordingly, when a thermoplastic resin film is used as the recording medium, it is necessary to keep the fixing temperature relatively low by forming the toner image using toner particles containing a low-molecular-weight binder resin.

In the method of preparing a toner image printed material according to this exemplary embodiment, since a coating liquid containing a polyisocyanate component, a polyol component, and a solvent component which swells or dissolves the polyester resin is applied to a toner image formed with a toner including toner particles containing, as a binder resin, a high-hydroxyl-value polyester resin having a hydroxyl value of 25 mgKOH/g or higher, the polyester resin included in the toner image reacts with the polyisocyanate component in the coating liquid, and thus the generation of urethane bonds is promoted.

In addition, it is thought that since the solvent component contained in the coating liquid swells or dissolves the polyester resin contained in the toner image, the polyisocyanate component penetrates into the toner image and urethane bonds are easily formed. In this manner, since the urethane bonds are formed not only on the surface, but also in the inside of the toner image, the strength of the toner image and the adhesive strength of the toner image with respect to the recording medium, that is, the fixing strength of the toner image, are thought to increase.

Image Forming Process

In the image forming process, a toner image is formed on a recording medium with a toner including toner particles containing, as a binder resin, a polyester resin having a hydroxyl value of 25 mgKOH/g or higher.

Recording Medium

The recording medium used in this exemplary embodiment is not particularly limited, and may be selected according to the use of a toner image printed material to be prepared. For example, a recording sheet, a cast-coated sheet, an adhesive labeling sheet, and a resin film may be used.

In the method of preparing a toner image printed material according to this exemplary embodiment, since a toner image may be formed using toner particles containing a polyester resin having a low molecular weight, and the adhesive properties of the toner image may be improved by keeping the fixing temperature relatively low, a thermoplastic resin film may also be favorably used. Examples of the thermoplastic resin film include biaxially stretched polypropylene (OPP), unstretched polypropylene (CPP), biaxially stretched nylon (ONY), and polythylene terephthalate (PET).

The thickness of the recording medium is also not particularly limited, and may be selected according to the use of a toner image printed material to be prepared. In the method of preparing a toner image printed material according to this exemplary embodiment, since the fixing properties of the toner image may be improved by keeping the fixing temperature relatively low, a thermoplastic resin film having a small thickness and low heat resistance as a recording medium, such as a thermoplastic resin film having a thickness of from 10 μm to 30 μm, may also be favorably used.

According to the method of preparing a toner image printed material according to this exemplary embodiment, the strength and the fixing properties of the toner image may be increased even when toner particles containing a polyester resin having high fluidity and a low molecular weight are used in the process of fixing the toner image. Thus, for example, the occurrence of toner offset when an image is formed on a thermoplastic resin film for a soft package material is also effectively prevented.

Toner

In this exemplary embodiment, a toner including toner particles containing, as a binder resin, a polyester resin having a hydroxyl value of 25 mgKOH/g or higher is used.

The toner used in this exemplary embodiment may contain a colorant (coloring material), a release agent, and the like other than the polyester resin as a main component (component having the greatest content) having a hydroxyl value of 25 mgKOH/g or higher, and an external additive may also be contained therein.

Polyester Resin Having Hydroxyl Value of 25 mgKOH/g or

Higher

In this exemplary embodiment, a value measured according to DIN (German Industrial Standard) 53 240-02 is employed as the hydroxyl value of the polyester resin. Specifically, approximately 2 g to 3 g of a polyester resin is dissolved in dichloromethane or tetrahydrofuran (THF). 4-dimethylaminopyridine is used as a catalyst, and esterification is carried out at room temperature (25° C.) by acetic anhydride. After hydrolysis of the anhydrous compound which does not react, titration is performed with 0.5 N methanolic KOH.

Using the high-hydroxyl-value polyester resin having a hydroxyl value of 25 mgKOH/g or higher as the binder resin of the toner particles, many urethane bonds are generated by the reaction between the hydroxyl group of the polyester resin and the isocyanate group of the polyisocyanate component, the molecular weight increases, and the strength and the adhesive properties of the toner image are thus improved. From such a viewpoint, the hydroxyl value of the polyester resin contained in the toner particles is preferably 30 mgKOH/g or higher, and more preferably 50 mgKOH/g or higher.

The upper limit of the hydroxyl value of the polyester resin contained in the toner particles is not particularly limited. However, it is preferably 80 mgKOH/g or lower from the viewpoint of charge stability under a high humidity environment.

In this exemplary embodiment, the high-hydroxyl-value polyester resin is primarily obtained by, for example, condensation polymerization of polycarboxylic acids and polyols.

Examples of the polycarboxylic acid include aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acids such as cyclohexane dicarboxylic acid. These polycarboxylic acids may be used alone or in combination of two or more kinds thereof.

Among these polycarboxylic acids, aromatic carboxylic acids are preferably used, and in order to form a crosslinked structure or a branched structure for the purpose of securing good fixability, a tri- or higher-valent carboxylic acid (such as trimellitic acid or its anhydride) may be used in combination with a dicarboxylic acid.

Example of the polyol include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as ethyleneoxide adduct of bisphenol A and propylene oxide adduct of bisphenol A. These polyols are used alone or in combination of two or more kinds thereof.

Among these polyols, aromatic diols and alicyclic diols are preferable, and aromatic diols are more preferable. In order to form a crosslinked structure or a branched structure for the purpose of securing good fixability, a trihydric or higher hydric alcohol (glycerin, trimethylolpropane, and pentaerythritol) may be used in combination with a diol.

The high-hydroxyl-value polyester resin contained as a binder resin in the toner particles used in this exemplary embodiment is preferably a polyvalent (di- or higher-valent) resin. Since the high-hydroxyl-value polyester resin contained in the toner particles used in this exemplary embodiment include two or more hydroxyl groups in one molecule, the molecular weight easily increases by the reaction with the polyisocyanate component contained in the coating liquid. From the viewpoint of preparing a polyvalent polyester resin having a hydroxyl value of 25 mgKOH/g or higher, the high-hydroxyl-value polyester resin is preferably prepared by a transesterification reaction. For example, when reacting dimethyl terephthalate with ethylene glycol, polyethylene terephthalate and methanol are obtained, and the polymerization reaction proceeds by vaporizing the methanol. In this case, since all of the terminals of the polymer chain include hydroxyl groups, a polyester resin having a high hydroxyl value may be prepared.

The glass transition temperature (Tg) of the high-hydroxyl-value polyester resin used in this exemplary embodiment is preferably in the range of from 50° C. to 80° C., and more preferably in the range of from 55° C. to 65° C.

The glass transition temperature (Tg) is measured according to ASTM D3418-8 using, for example, a DSC measurement device (differential scanning calorimetry DSC-7, manufactured by Perkin Elmer Co., Ltd.). The temperature of a detecting portion of the device is corrected using melting temperatures of indium and zinc, and the quantity of heat is corrected using heat of melting of indium. An aluminum pan is used for a sample, and an empty pan is set for control to perform the measurement at a rate of temperature increase of 10° C./min.

The weight average molecular weight (Mw) of the high-hydroxyl-value polyester resin used in this exemplary embodiment is preferably in the range of from 5,000 to 30,000, and more preferably in the range of from 10,000 to 25,000 from the viewpoint of keeping the fixing temperature low and of obtaining a toner image having high strength after fixing.

When the molecular weight is lower than 5,000, the toner image has no strength, and thus the toner image may be separated or may crack in the course of winding. When the molecular weight is higher than 30,000, the fixing temperature increases, and thus the film may be unacceptably deformed or shrunk. The molecular weight is more preferably from 10,000 to 25,000 from the viewpoint of satisfying both of them.

The weight average molecular weight is a value measured by gel permeation chromatography (GPC). "HLC-8120GPC, SC-8020 (manufactured by Tosoh Corporation)" is used as a GPC device, two columns "TSKGEL, SUPER HM-H (manufactured by Tosoh Corporation, 6.0 mm ID×15 cm) are used, and tetrahydrofuran (THF) is used as an eluent. A test is performed under the conditions of a sample concentration of 0.5%, a flow rate of 0.6 ml/min, a sample injection amount of 10 μl, and a measurement temperature of 40° C. using a refractive index (RI) detector. In addition, a calibration curve is prepared using samples of "polystyrene standard sample TSK standard" manufactured by Tosoh Corporation: "A-500", "F-1", "F-10", "F-80", "F-380", "A-2500", "F-4", "F-40", "F-128", and "F-700".

Release Agent

Examples of the release agent include low-molecular-weight polyolefins such as polyethylene, polypropylene, and polybutene; silicones, fatty acid amides such as oleic acid amide, erucic acid amide, ricinolic acid amide, and stearic acid amide; vegetable waxes such as carnauba wax, rice wax, candelilla wax, Japan tallow, and Jojoba oil; animal waxes such as beeswax; mineral or petroleum waxes such as Montan wax, ozokerite, ceresin, paraffin wax, microcrystalline wax, and Fischer-Tropsch wax, and modified products thereof.

The amount of the release agent added is preferably in the range of from 0.5% by weight to 50% by weight, more preferably in the range of from 1% by weight to 30% by weight, and even more preferably in the range of from 5% by weight to 15% by weight with respect to all of the toner particles.

Colorant

Examples of the colorant used in this exemplary embodiment include various pigments such as carbon black, chrome yellow, hansa yellow, benzidine yellow, threne yellow, quinoline yellow, permanent orange GTR, pyrazolone orange, vulkan orange, watchung red, permanent red, Brilliant Carmine 3B, Brilliant Carmine 6B, DuPont oil red, pyrazolone red, lithol red, rhodamine B lake, lake red C, rose bengal, aniline blue, ultramarine blue, calco oil blue, methylene blue chloride, phthalocyanine blue, phthalocyanine green, and malachite green oxalate, and various dyes based on acridine, xanthene, azo, benzoquinone, azine, anthraquinone, thioindigo, dioxazine, thiazine, azomethine, indigo, phthalocyanine, aniline black, polyemthine, triphenylmethane, diphenylmethane, and thiazole, and these may be used alone or in combination of two or more kinds thereof.

Other Additive Components

When the toner particles used in this exemplary embodiment are used as magnetic toner particles, magnetic particles are contained. Examples of the magnetic particles used herein include magnetic oxides such as ferrite and magnetite; magnetic metals such as reduced iron, cobalt, nickel, and manganese; and alloys or compounds containing these magnetic metals. Furthermore, various charge controlling agents which are generally used, such as quaternary ammonium salt, nigrosine compounds, and triphenylmethane pigments may be added.

The toner particles used in this exemplary embodiment may contain inorganic particles. Inorganic particles having a central particle diameter of from 5 nm to 30 nm and inorganic particles having a central particle diameter of from 30 nm to 100 nm are more preferably contained in the range of from 0.5% by weight to 10% by weight with respect to the toner in view of lifetime.

As the inorganic particles, silica, silica treated with a hydrophobizing agent, titanium oxide, alumina, calcium carbonate, magnesium carbonate, tricalcium phosphate, colloidal silica, cation surface-treated colloidal silica, anion surface-treated colloidal silica, and the like are used. These inorganic particles are dispersed in advance using an ultrasonic disperser in the presence of an ionic surfactant, but colloidal silica which does not require this dispersion treatment is more preferably used.

A known external additive may be externally added to the toner particles used in this exemplary embodiment. As the external additive, inorganic particles such as silica, alumina, titania, calcium carbonate, magnesium carbonate, and tricalcium phosphate are used. For example, as a fluidity auxiliary agent or a cleaning auxiliary agent, inorganic particles such as silica, alumina, titania, and calcium carbonate, and resin particles such as a vinyl resin, a polyester resin, and a silicone resin are used. The method of adding the external additive is not particularly limited, and the external additive in a dried state may be added to the surfaces of the toner particles with a shearing force.

The toner used in this exemplary embodiment may be prepared through a known toner preparing method.

For example, a toner prepared by a kneading and pulverizing method including adding a binder resin, a colorant, a release agent, and if necessary, a charge controlling agent and the like, and kneading, pulverizing, and classifying the mixture; a method of changing the shape of the particles obtained by the kneading and pulverizing method with mechanical impacts or thermal energy; an emulsion polymerization and aggregation method including mixing a dispersion formed by emulsion polymerization of a polymerizable monomer of a binder resin with a dispersion of a colorant, a release agent, and if necessary, a charge controlling agent and the like, and aggregating and coalescing the mixture by heating for obtaining toner particles; a suspension polymerization method of performing polymerization by suspending a solution of a polymerizable monomer for obtaining a binder resin, a colorant, a release agent, and if necessary, a charge controlling agent and the like in a water-based solvent; a dissolution and suspension method of performing granulation by suspending a solution of a binder resin, a colorant, a release agent, and if necessary, a charge controlling agent and the like in a water-based solvent; or the like is used.

A volume average particle diameter D50v of the toner particles used in this exemplary embodiment is preferably in the range of from 0.1 μm to 10 μm, and more preferably in the range of from 0.5 μm to 4 μm.

A volume average particle diameter distribution index GSDv of the toner particles is preferably 1.28 or less. A number average particle diameter distribution index GSDp is preferably 1.30 or less. The volume average particle diameter distribution index GSDv is more preferably 1.25 or less, and the number average particle diameter distribution index GSDp is more preferably 1.25 or less.

In this exemplary embodiment, the volume average particle diameter D50v and various particle diameter distribution indices are measured using, for example, COULTER MULTISIZER II (manufactured by Beckman Coulter, Inc.) with ISOTON-II (manufactured by Beckman Coulter, Inc.) as an electrolyte. In the measurement, from 0.5 mg to 50 mg of a measurement sample is added to 2 ml of a 5% aqueous solution of a surfactant as a dispersant which is preferably sodium alkylbenzenesulfonate, and the obtained material is added to from 100 ml to 150 ml of an electrolyte.

The electrolyte in which the sample is suspended is dispersed for 1 minute using an ultrasonic disperser, and a particle diameter distribution of particles having a particle diameter in the range of from 2.0 μm to 60 μm is measured by the above-described COULTER MULTISIZER II using an aperture having an aperture diameter of 100 μm. The number of particles to be sampled is 50,000.

Cumulative distributions by volume and by number are drawn from the side of the smallest diameter with respect to particle diameter ranges (channels) separated based on the particle diameter distribution measured as described above. The particle diameter when the cumulative percentage becomes 16% is defined as that corresponding to a cumulative volume average particle diameter D16v and a cumulative number average particle diameter D16p, while the particle diameter when the cumulative percentage becomes 50% is defined as that corresponding to a cumulative volume average particle diameter D50v and a cumulative number average particle diameter D50p. Furthermore, the particle diameter when the cumulative percentage becomes 84% is defined as that corresponding to a cumulative volume average particle diameter D84v and a cumulative number average particle diameter D84p.

Using these, the volume average particle diameter distribution index (GSDv) is calculated by $(D84v/D16v)^{1/2}$, while the number average particle diameter distribution index (GSDp) is calculated by $(D84p/D16p)^{1/2}$.

The method (device) of forming a toner image on a recording medium using the toner including the above-described toner particles is not particularly limited, and may be any one of a dry developing-type image forming method (device) and a wet developing-type image forming method (device) (developing method using liquid developer).

In the dry developing-type image forming method, a two-component developer containing a toner and a carrier may be used as the developer. Examples of the carrier used in the two-component developer include an iron powder carrier, glass beads, a ferrite powder carrier, and a surface-coated ferrite carrier.

In the wet developing-type image forming method, examples of the carrier liquid used in the liquid developer include a silicone oil and a saturated hydrocarbon oil (mineral oil). A liquid developer in which a toner having a small particle diameter of approximately 1 μm is dispersed in a volatile carrier liquid such as ISOPAR L (manufactured by Exxon Mobil Corporation) may be used.

The method of supplying a recording medium in the image forming process is not particularly limited, and for example, when printing is performed on a film for soft packaging, a film wound like a roll may be used, and the printing may be continuously performed on the drawn film.

Coating Process

In the coating process, a coating film is formed by applying a coating liquid (hereinafter, may be referred to as "coating agent") containing a polyisocyanate component, a polyol component, and a solvent component which swells or dissolves the polyester resin to a surface having the toner image thereon of the recording medium.

Coating Liquid

The coating liquid used in this exemplary embodiment contains a polyisocyanate component, a polyol component, and a solvent component which swells or dissolves the polyester resin.

Polyisocyanate Component

The coating liquid which is applied to the toner image contains a polyisocyanate component, that is, a bi- or higher-functional isocyanate compound.

Examples of the bifunctional isocyanate compound include a mixture of 2,4-tolylene diisocyanate and 2,6-tolylene diisocyanate, usually called tolylene diisocyanate, 4,4-diphenylmethane diisocyanate, xylylene diisocyanate, 1,3-bis(isocyanate methyl) cyclohexane, 1,6-hexamethylenediisocyanate, isophorone diisocyanate, tetramethylxylylene diisocyanate, and m-isopropenyl-α,α-dimethylbenzyl isocyanate. Materials obtained by modifying these compounds may also be used.

Examples of the trifunctional isocyanate compound include triphenylmethane triisocyanate, tris(isocyanatephenyl)thiophosphate, 1,8-diisocyanate-4-isocyanatemethyloctane, and lysine ester triisocyanate, and materials obtained by modifying these compounds may also be used.

Examples of the tetra- or higher-functional isocyanate compound include compounds usually called polymeric 4,4-diphenylmethane diisocyanate expressed by the following formula.

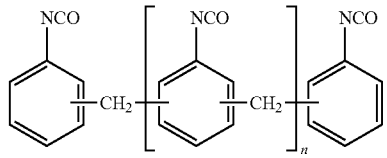

n is an integer of 2 or more.

Other examples thereof include adduct of diphenylmethane diisocyanate and polyvalent polyol and adduct of tolylene diisocyanate and polyvalent polyol.

Solvent

The coating liquid contains, as the solvent component, a solvent which swells or dissolves the polyester resin.

The solvent is not limited as long as it has properties of swelling or dissolving the high-hydroxyl-value polyester resin contained in the toner particles. Here, "swell" means that the solvent penetrates into the polyester resin, and thus the viscosity of the polyester resin is reduced.

Since the solvent contained in the coating liquid swells or dissolves and plasticizes the polyester resin in the toner image, permeability of the polyisocyanate component increases, and thus the amount of urethane bonds generated may be increased.

When the high-hydroxyl-value polyester resin in the toner image is extremely dissolved by the solvent, the disturbance of the toner image may occur before the drying process. The SP value of the solvent contained in the coating liquid is preferably from 8.5 to 10.0 from the viewpoint of appropriately swelling or dissolving the high-hydroxyl-value polyester resin.

Here, the solubility parameter (SP value) in this exemplary embodiment will be described.

The Hansen's solubility parameter is used as a SP value in this exemplary embodiment. The Hansen solubility parameter is given by dividing the Hildebrand's solubility parameter into three components of a dispersion item δD, a polar item of δP, and a hydrogen bond item δH, and by expressing them in a three-dimensional space. In this exemplary embodiment, a value calculated using the following expression is used.

$$\delta=(\delta D^2+\delta P^2+\delta H^2)^{1/2}$$

In the case of a mixed solvent, the calculation is performed as follows: for example, when Hansen's solubility parameters of a solvent 1 and a solvent 2 are [δD1, δP1, δH1] and [δD2, δP2, δH2], respectively, and a volume ratio of the solvent 1 and the solvent 2 is V1:V2, a dispersion item δDm, a polar item δPm, and a hydrogen bond item δHm of the mixed solvent are expressed by the following expressions.

$$\delta Dm=(V1\times\delta D1+V2\times\delta D2)/(V1+V2)$$

$$\delta Pm=(V1\times\delta P1+V2\times\delta P2)/(V1+V2)$$

$$\delta Hm=(V1\times\delta H1+V2\times\delta H2)/(V1+V2)$$

The solubility parameter of the mixed solvent is obtained by the following expression.

$$\delta=(\delta Dm^2+\delta Pm^2+\delta Hm^2)^{1/2}$$

The solvent contained in the coating liquid used in this exemplary embodiment is preferably a solvent which promotes the plasticization of the high-hydroxyl-value polyester resin at a temperature of the drying process rather than at a temperature of the coating process.

Since the temperature (drying temperature) in the drying process is higher than the temperature in the coating process, the polyester resin contained in the toner image is more easily plasticized in the drying process than in the coating process. In this exemplary embodiment, since the coating liquid containing the solvent which swells or dissolves the polyester resin is used, the polyester resin contained in the toner image is plasticized to some extent by the application of the coating liquid in the coating process.

However, since the plasticization of the polyester resin contained in the toner image is promoted by the solvent contained in the coating liquid at the temperature in the drying process rather than at the temperature in the coating process, toner offset from the coating process to the drying process is prevented. In the drying process, since the plasticization by the solvent contained in the coating liquid is promoted, the solvent contained in the coating film is removed, and, in addition, the polyisocyanate component intrudes not only to the surface, but also to the inside of the toner image, and thus urethane bonds are easily formed.

From the viewpoint of promoting the plasticization by the solvent in the drying process rather than in the coating process, the degree of the plasticization of the high-hydroxyl-value polyester resin by the solvent is preferably low at the temperature in the coating process, and the degree of the plasticization of the high-hydroxyl-value polyester resin by the solvent is preferably high at the drying temperature in the drying process. Specifically, when a complex viscosity of the high-hydroxyl-value polyester resin at the temperature of the coating process is denoted as A1 (Pa·s), a complex viscosity of the high-hydroxyl-value polyester resin dipped in the solvent at the temperature of the coating process is denoted as B1 (Pa·s), a complex viscosity of the high-hydroxyl-value polyester resin at the temperature of the drying process is denoted as A2 (Pa·s), and a complex viscosity of the high-hydroxyl-value polyester resin dipped in the solvent at the temperature of the drying process is denoted as B2 (Pa·s), the following expressions (1) and (2) are preferably satisfied.

$$A1/B1<10 \quad (1)$$

$$A2/B2\geq 100 \quad (2)$$

Particularly, from the viewpoint of preventing the occurrence of toner offset, the complex viscosity ratio A1/B1 of the high-hydroxyl-value polyester resin at the temperature of the coating process is more preferably 3 or lower, and the complex viscosity ratio A2/B2 of the high-hydroxyl-value polyester resin at the temperature of the drying process is more preferably 300 or higher.

Here, the complex viscosity of the polyester resin is measured by a dynamic viscoelasticity measurement device. Using a parallel plate, under the conditions of a frequency of 1 radian/sec and a strain of 1%, the viscoelasticity (complex viscosity) of a resin heat-molded into a parallel flat plate for the dynamic viscoelasticity measurement or the resin prepared by dipping 10 parts of the resin heat-molded in 90 parts of a solvent for 60 seconds at a coating temperature or a drying temperature is measured at the coating temperature or the drying temperature.

Examples of the suitable solvent contained in the coating liquid used in this exemplary embodiment include ethyl acetate (SP value: 9.0), methyl ethyl ketone (SP value: 9.3), and toluene (SP value: 8.8).

Polyol Component

Examples of the polyol component include polyether polyol and polyester polyol.

Examples of the polyether polyol include a material obtained by addition polymerization of an ethylene oxide to a hydroxyl group of polypropylene glycol, polytetramethylene ether glycol, and a material obtained by copolymerizing tetramethylene ether glycol with an ethylene oxide or a propylene oxide.

Examples of the polyester polyol include a compound synthesized by a polycondensation reaction of an organic polybasic acid with a monomeric polyol. Examples of the organic polybasic acid include isophthalic acid, terephthalic acid, adipic acid, and sebacic acid, and examples of the monomeric polyol include diols such as ethylene glycol, propylene glycol, butylene glycol, hexamethylene glycol, and neopentyl glycol, trials such as glycerin, trimethylol propane, trimethylol ethane, and 1,2,6-hexanetriol, and pentaerythritol.

Since the coating liquid used in this exemplary embodiment contains the polyol component, the coating film functions as an adhesive layer. Therefore, in the drying process, the sticking process, and/or an aging process to be described later, by causing hardening by generating urethane bonds not only between the polyisocyanate component and the polyester resin, but also between the polyisocyanate component and the polyol component, adhesive properties (adhesive strength) of a sticking base to be stuck may be increased.

When the sticking base is not stuck, the coating film after drying functions as a protective layer on the toner image surface.

Regarding the content of the polyol component in the coating liquid used in this exemplary embodiment, the molar ratio of the polyisocyanate component and the polyol component is preferably nearly 1:1 from the viewpoint of easy generation of urethane bonds by the reaction of the polyisocyanate component with the polyol component.

If necessary, various additives may be added to the coating liquid. For example, a coupling agent for improving the adhesive properties, a phenol resin for an improvement in the initial adhesive properties or for viscosity adjustment, an adhesive property imparting agent such as a rosin resin and a xylene resin, inorganic particles for adjustment of a change in the volume of the adhesive layer or for viscosity adjustment, a catalyst for adjustment of a hardening speed, an ultraviolet absorber, an antioxidant, a heat-resistant stabilizer, and the like are appropriately added.

Coating Method

The method of applying the coating liquid to the toner image surface formed on the recording medium is not particularly limited, and examples thereof include gravure coating, blade coating, air knife coating, roll coating, reverse roll coating, curtain coating, bar coating, and spray coating.

A coating film is formed on the print by applying the coating liquid to the toner image surface. The amount of the coating liquid applied also depends on the concentration of the polyisocyanate component and the like, but when the amount of the coating liquid applied is too small, the generation of urethane bonds may be insufficient, or coating unevenness may occur, and when the amount of the coating liquid applied is too large, the drying time increases. From such viewpoints, the amount of the coating liquid applied to the toner image surface is preferably from 0.5 gsm (gram per square meter) to 10 gsm, and more preferably from 1 gsm to 5 gsm.

In the method of preparing a toner image printed material of this exemplary embodiment, before a toner image is transferred to a recording medium from a photoreceptor or an intermediate transfer member, and is fixed by heating and pressurization, the coating liquid may be applied to the unfixed toner image. However, the coating liquid is preferably applied to the toner image after fixing from the viewpoint of preventing the occurrence of the disturbance of the toner image caused by the application of the coating liquid.

Drying Process

In the drying process, the coating film is dried to remove at least a part of the solvent contained in the coating film.

Examples of the drying method include warm air drying and heating by a halogen heater or the like. A method of performing drying by bringing a heating plate, a heating roll, or the like into contact with the rear surface (that is, recording medium side) of the toner image is also included. A method of performing drying by blowing warm air to the coating film is preferable from the viewpoint of efficiently removing the solvent contained in the coating film and of preventing the deformation of the film when using a thermoplastic resin film as the recording medium.

The drying temperature may be selected according to the kind of the solvent. The higher the temperature, the easier the removal of the solvent in a short period of time. However, when a thermoplastic resin film is used as the recording medium, the recording medium may be deformed when the drying temperature is too high.

In addition, since there is a temperature difference between the coating process and the drying process, the solubility of the toner in the solvent varies, and thus toner offset in the coating process may be prevented, and the penetration of the solvent and the polyisocyanate component into the toner image in the drying process may be increased. From such viewpoints, for example, warm air drying is preferably performed by setting the drying temperature in the range of from 50° C. to 100° C.

Sticking Process

For example, a lamination configuration is primarily used in soft packaging, and when a printed material having a lamination configuration is prepared in this exemplary embodiment, a sticking base is stuck to the recording medium via the dried coating film (adhesive layer).

When the sticking base is stuck to the toner image surface side of the recording medium, the thickness of the adhesive layer also depends on the use of a toner image printed material to be prepared, but for example, the thickness after drying is preferably in the range of from 1 μm to 5 μm.

The sticking base may be selected according to the use, but preferably has high light permeability such that the toner image of the printed material may be visually confirmed. For example, an unstretched polypropylene (CPP) film may be used.

The thickness of the sticking base is not particularly limited. However, it is, for example, from 0.5 μm to 5 μm from the viewpoint of a function of protecting the toner image and lightweight properties.

An aluminum vapor deposition film may be formed on the dried coating film without the sticking of the sticking base.

Aging Process

After the coating film is dried, or after the sticking base is stuck to the recording medium via the coating film if necessary, the aging is preferably performed under the environment of from 40° C. to 60° C. By providing the aging process, the generation of urethane bonds on the surface and in the inside of the toner image is further promoted, and thus the coating film is hardened, and the adhesion (fixing strength) of the toner image and the adhesion of the sticking base may be further increased.

The aging time also depends on the kind of the recording medium, the composition of the coating liquid, and the like, but when the aging time is too short, the generation of urethane bonds is not sufficiently promoted, and when the aging time is too long, the productivity is reduced. From such viewpoints, in general, the aging time is preferably from 24 hours to 72 hours.

Since the aging time varies with the temperature, the temperature and the time in the aging process are more preferably set such that, for example, the time is 48 hours or longer at 40° C. and is 10 hours or longer at 60° C.

Device for Preparing Toner Image Printed Material

Next, a device for preparing a toner image printed material according to this exemplary embodiment will be described.

The device for preparing a toner image printed material according to this exemplary embodiment is provided with a coating unit which applies, to a surface having a toner image thereon of a recording medium having the toner image formed with a toner including toner particles containing, as a binder resin, a polyester resin having a hydroxyl value of 25 mgKOH/g or higher, a coating liquid containing a solvent which swells or dissolves the polyester resin and a polyisocyanate component to form a coating film, and a drying unit which dries the coating film.

The device for preparing a toner image printed material is preferably configured to be further provided with an image forming unit which forms the toner image on the recording medium.

FIG. 1 is a schematic diagram illustrating an example of a configuration of a device for preparing a toner image printed material according to this exemplary embodiment.

A device for preparing a toner image printed material 100 includes, as the image forming unit, a photoreceptor (image holding member) 10, a charging device 20, an exposure device (latent image forming device) 12, a developing device 14, an intermediate transfer member 16, a cleaner 18, a transfer roll (transfer device) 28, and heating and pressurization rolls 34A and 34B (fixing device).

The photoreceptor 10 has a cylindrical shape, and the charging device 20, the exposure device 12, the developing device 14, the intermediate transfer member 16, and the cleaner 18 are sequentially provided at the outer circumference of the photoreceptor 10. The transfer roll 28 is provided at a position in which a toner image 26 transferred to the intermediate transfer member 16 is transferred to a recording medium 30. A pair of the heating and pressurization rolls 34A and 34B is provided on the downstream side of the transfer roll 28 in a direction in which the recording medium 30 moves.

In addition, the device for preparing a toner image printed material illustrated in FIG. 1 is provided with a coating device 36 as the coating unit on the downstream side of the heating and pressurization rolls 34A and 34B, and a drying device 38 as the drying unit on the downstream side of the coating device 36.

Hereinafter, operations of the toner image print preparing device 100 will be simply described.

The charging device 20 charges a surface of the photoreceptor 10 to a predetermined potential, and the exposure device 12 exposes the charged surface to, for example, laser beams based on an image signal to form an electrostatic latent image.

The developing device 14 is configured to include a developing roll 14*a* and a developer storage container 14*b*. The developer is a two-component developer including: a toner including toner particles containing, as a binder resin, a polyester resin having a hydroxyl value of 25 mgKOH/g or higher; and a carrier. The developer may be a one-component developer including only a toner.

The developing roll 14*a* is provided such that a part thereof is brought into contact with a developer 24 stored in the developer storage container 14*b*. Toner particles are dispersed in the developer 24, and for example, the developer 24 may be stirred by an agitation member (not shown) provided in the developer storage container 14*b*.

The developer 24 supplied to the developing roll 14*a* is transported to the photoreceptor 10 in a state in which its amount is limited to a supply amount set by a regulation member (not shown), and the transported developer is supplied to the electrostatic latent image at a position in which the developing roll 14*a* faces (or is brought into contact with) the photoreceptor 10. Accordingly, the electrostatic latent image is developed, and becomes the toner image 26.

The developed toner image 26 is transported to the photoreceptor 10 rotating in the direction B of the drawing, and is transferred to the recording medium 30. However, in this exemplary embodiment, before being transferred to the recording medium 30, the toner image is transferred to the intermediate transfer member 16. At this time, a difference in the circumferential speed may be provided between the photoreceptor 10 and the intermediate transfer member 16.

Next, the toner image transported in the direction of C of the drawing by the intermediate transfer member 16 is transferred to the recording medium 30 at a position in which the toner image and the transfer roll 28 are in contact with each other.

The unfixed toner image transferred to the recording medium 30 is heated and pressurized by the heating and pressurization rolls 34A and 34B, and is thus fixed to the recording medium 30.

The heating and pressurization rolls 34A and 34B are disposed to be opposed to each other so as to form a nip for interposing the recording medium 30 in between. The heating and pressurization rolls 34A and 34B include, for example, an elastic rubber layer and a release layer for toner release which are formed on a metal roll, and sandwiched the recording medium 30 therebetween by a pressurizing mechanism (not shown) such that a predetermined pressure and a predetermined nip width are obtained. At least one of the heating and pressurization rolls 34A and 34B is provided with a heater, but heaters may be provided at both of the heating and pressurization rolls 34A and 34B.

A fixed image 29 fixed on the recording medium 30 is transported to the coating device 36. The coating device 36 is configured to have two rolls 36A and 36B opposed to each other, and a container 36C which stores a coating liquid 37, and to apply the coating liquid 37 to the fixed image 29 through a gravure roll method. The coating liquid 37 contains a polyisocyanate component, a polyol component, and a solvent component which swells or dissolves the high-hydroxyl-value polyester resin contained in the toner particles (toner image). The coating liquid 37 may further contain a polyol component. The recording medium 30 having the fixed image 29 thereon is transported between the two rolls 36A and 36B respectively rotating in the directions shown in FIG. 1, the coating liquid 37 stored in the container 36C is adhered to a surface of the roll 36B, and the coating liquid adhering to the surface of the roll 36B is applied to the fixed image 29 on the recording medium 30.

The recording medium 30 on which the coating liquid is applied to the fixed image 29 is transported to the drying device 38. As illustrated in FIG. 1, when the drying is performed by non-contact heating from the side of the toner image as a heating target, a non-contact-type heating device such as a halogen heater or a hot-air dryer is employed as the drying device 38. When the toner image as a heating target is heated from the rear surface (that is, recording medium side) thereof, for example, a heating plate, a heating roll, or the like which is brought into contact with the rear surface is used.

The drying temperature in the drying device 38 also depends on the kind of the solvent and the kind of the recording medium, but is preferably from 50° C. to 100° C. When a thermoplastic resin film is used as the recording medium, the drying temperature is more preferably from 50° C. to lower than 90° C., and even more preferably from 50° C. to 80° C. The drying time is set according to a length of the drying device 38 in the direction in which the recording medium 30 moves, a processing speed, the kind of the solvent contained in the coating liquid, and the like.

After the drying device 38 dries the coating film 39 applied to the recording medium 30, the recording medium 30 is wound like a roll and collected by a collecting roll 42.

In the photoreceptor 10 in which the toner image 26 is transferred to the intermediate transfer member 16, the toner particles not transferred, but remaining on the photoreceptor 10 are transported up to a contact position with the cleaner 18, and are collected by the cleaner 18. When the transfer efficiency is almost 100% and the amount of remaining toner particles is reduced, the cleaner 18 may not be provided.

The device for preparing a toner image printed material 100 may be further provided with an erasing device (not shown) which erases the electricity on the surface of the photoreceptor 10 during the period from after the transfer to the next charging.

All of the charging device 20, the exposure device 12, the developing device 14, the intermediate transfer member 16, the transfer roll 28, the cleaner 18, the fixing devices (heating and pressurization rolls) 34A and 34B, the coating device 36, the drying device 38, and the collecting roll 42 of the device for preparing a toner image printed material 100 are operated in synchronization with the rotation speed of the photoreceptor 10.

The collected toner image printed material 40 is transported to an aging chamber (not shown), and is cured at a temperature of, for example, from 40° C. to 60° C. for from 10 hours to 72 hours, and thus the generation of urethane bonds in the toner image is promoted, and the fixing strength of the toner image is further improved.

EXAMPLES

Hereinafter, this exemplary embodiment will be described in detail with examples, but is not limited to the following examples. In the following description, "parts" and "%" indicating the amount mean "parts by weight" and "% by weight", respectively, unless otherwise noted.

Preparation of Carrier Particles

Mn—Mg Ferrite Particles (average particle diameter: 35 μm): 100 parts

Toluene: 10 parts

Styrene/Methyl Methacrylate/Dimethylaminoethyl (methacrylate copolymer, copolymerization ratio (molar ratio)=70:27:3, Mw=80,000): 0.7 parts The above-described components excluding the ferrite particles are stirred by a stirrer for 10 minutes to prepare a coating layer forming liquid. Next, the obtained coating layer forming liquid and the ferrite particles are put into a vacuum deaeration-type kneader, and stirred for 30 minutes at a temperature of 60° C. Then, the toluene is removed during the stirring under reduced pressure, and the drying is performed to form a coating layer. Then, carrier particles are obtained by sieving by a 75 μm-sieve.

Preparation of Toner 1

Polyester Resin (linear polyester obtained by polycondensation of ethylene oxide adduct of bisphenol A/cyclohexanedimethanol/dimethyl terephthalate, prepared by transesterification method. Hydroxyl value=30, Tg=60° C., Mw=15,000): 85 parts Coloring Material (C.I.Pigment Yellow 12): 15 parts The above-described materials are kneaded by an extruder. Next, the mixture is pulverized by a jet mill, and then classified using an air classifier to obtain colored toner particles having a D50 of 4 μm.

By changing the coloring material, colored toner particles of yellow (Y), magenta (M), cyan (C), and black (K) are obtained, respectively.

1.0% by weight of $TiO_2$ particles having an average particle diameter of 12 nm and 0.8% by weight of $SiO_2$ particles having an average particle diameter of 50 nm are added to the obtained respective colored toner particles, and mixed by a HENSCHEL MIXER to prepare a toner 1.

Preparation of Developer 1

6 parts of each colored toner of the toner 1 is mixed with 100 parts of the carrier particles by a V blender to prepare a developer, and thus a two-component developer 1 is obtained.

Preparation of Toner 2

Polyester Resin (linear polyester obtained by polycondensation of ethylene oxide adduct of bisphenol A/cyclohexanedimethanol/dimethyl terephthalate/trimellitic acid, prepared by transesterification method. Hydroxyl value=50, Tg=60° C., Mw=8,000): 85 parts Coloring Material (C.I.Pigment Yellow 12): 15 parts The above-described materials are kneaded by an extruder. Next, the mixture is pulverized by a jet mill, and then classified using an air classifier to obtain colored toner particles having a D50 of 4 μm.

By changing the coloring material, colored toner particles of Y, M, C, and K are obtained, respectively.

1.0% by weight of $TiO_2$ particles having an average particle diameter of 12 nm and 0.8% by weight of $SiO_2$ particles having an average particle diameter of 50 nm are added to the obtained respective colored toner particles, and mixed by a HENSCHEL MIXER to prepare a toner 2.

Preparation of Developer 2

6 parts of each colored toner of the toner 2 is mixed with 100 parts of the carrier particles by a V blender to prepare a developer, and thus a two-component developer 2 is obtained.

Preparation of Toner 3

Polyester Resin (linear polyester obtained by polycondensation of ethylene oxide adduct of bisphenol A/cyclohexanedimethanol/terephthalic acid. Hydroxyl value=20, Tg=60° C., Mw=15,000): 85 parts Coloring Material: 15 parts The above-described materials are kneaded by an extruder. Next, the mixture is pulverized by a jet mill, and then classified using an air classifier to obtain colored toner particles having a D50 of 4 μm.

By changing the coloring material, colored toner particles of Y, M, C, and K are obtained, respectively.

1.0% by weight of $TiO_2$ particles having an average particle diameter of 12 nm and 0.8% by weight of $SiO_2$ particles having an average particle diameter of 50 nm are added to the obtained colored toner particles, and mixed by a HENSCHEL MIXER to prepare a toner 3.

Preparation of Developer 3

6 parts of each colored toner of the toner 3 is mixed with 100 parts of the carrier particles by a V blender to prepare a developer, and thus a two-component developer 3 is obtained.

Preparation of Toner 4

Styrene-Acrylic Resin (styrene/n-butyl acrylate/acrylic acid copolymer, monomer ratio (molar ratio)=80:20:2 (molar ratio), Tg=58° C., Mw=23,000): 85 parts Yellow Pigment (C.I.Pigment Yellow 12): 15 parts The above-described materials are kneaded by an extruder. Next, the mixture is pulverized by a jet mill, and then processed in the same manner as in the preparation of the toner 1 to prepare a toner 4.

Preparation of Developer 4

6 parts of each colored toner of the toner 4 is mixed with 100 parts of the carrier particles by a V blender to prepare a developer, and thus a two-component developer 4 is obtained.

Preparation of Coating Agent 1

Urethane Prepolymer (prepolymer in which the content of NCO group composed of polyoxypropylene bisphenol A and tolylene diisocyanate is 9.5%): 100 parts Polyester Polyol (TAKELAC U-53, hydroxyl value=174, manufactured by Takeda Pharmaceutical Company Ltd.): 180 parts 70 parts of ethyl acetate (SP value: 9.0) is added to and mixed with 30 parts of the two-liquid component, and thus a coating agent 1 is prepared.

Preparation of Coating Agent 2

Polyisocyanate (IPDI-H2921, in which the content of NCO group including isophorone diisocyanate as a main component is 28.0%, manufactured by Huels AG): 100 parts Polyether Polyol (hydroxyl value=182): 510 parts 70 parts of methyl ethyl ketone (SP value: 9.3) is added to and mixed with 30 parts of the two-liquid component, and thus a coating agent 2 is prepared.

Preparation of Coating Agent 3

Polyisocyanate (IPDI-H2921, in which the content of NCO group including isophorone diisocyanate as a main component is 28.0%, manufactured by Huels AG): 100 parts Acrylic Polyol (hydroxyl value=166): 560 parts 70 parts of toluene (SP value: 8.8) is added to and mixed with 30 parts of the two-liquid component, and thus a coating agent 3 is prepared.

Coating Agent 4

2K-SF-350A/HA-550B (manufactured by DIC Corporation, solventless) is prepared as a coating agent containing no solvent.

Example 1

In C1000 PRESS manufactured by Fuji Xerox Co., Ltd., a toner image is formed using the developer 2 (toner 2) on a polyester film having a thickness of 12 μm and having a corona-treated image surface, and is heated with a roll to perform fixing.

The polyester film having the toner image formed thereon is set in a dry laminator (FL2 manufactured by Fuji Kikai Kogyo Co., Ltd.), and 10 gsm of the coating agent 2 is applied to the toner image using a gravure roll, and is then dried for 30 seconds with warm air of 80° C. to form a protective layer.

Next, the polyester film in which the protective layer is formed on the toner image surface is taken out from the dry laminator, and is cured for 48 hours in an aging chamber in which the temperature is adjusted to 50° C.

The complex viscosity of the binder resin used in the preparation of the toner 2 is measured through the following method, and the plasticity of the binder resin by the solvent at the coating temperature and at the drying temperature is evaluated.

Measurement of Complex Viscosity

The viscoelasticity (complex viscosity) is measured by a dynamic viscoelasticity measurement device. Using a parallel plate, under the conditions of a frequency of 1 radian/sec and a strain of 1%, the viscoelasticity of 10 parts of a resin heat-molded into a parallel flat plate for the dynamic viscoelasticity measurement, or 10 parts of the resin after dipping in 90 parts of a solvent for 60 seconds at a coating temperature or a drying temperature is measured at the coating temperature or the drying temperature. The results are shown as follows.

Coating Temperature (25° C.)

Resin heat-molded and not subjected to dipping in solvent; $10^7$ Pa·s

Resin heat-molded and subjected to dipping in solvent; $2\times10^6$ Pa·s

Drying Temperature (80° C.):

Resin heat-molded and not subjected to dipping in solvent; $2\times10^5$ Pa·s

Resin heat-molded and subjected to dipping in solvent; $10^2$ Pa·s

Example 2

In C1000 PRESS manufactured by Fuji Xerox Co., Ltd., a toner image is formed using the developer 1 (toner 1) on a cast-coated sheet, and is heated with a roll to perform fixing.

The cast-coated sheet having the toner image formed thereon is set in a dry laminator (manufactured by Fuji Kikai Kogyo Co., Ltd., FL2), and 10 gsm of the coating agent 3 is applied to the toner image using a gravure roll, and is then dried for 30 seconds with warm air of 80° C. to form a protective layer.

Next, the cast-coated sheet in which the protective layer is formed on the toner image surface is taken out from the dry laminator, and is cured for 48 hours in an aging chamber in which the temperature is adjusted to 50° C.

The complex viscosity of the binder resin of the toner measured in the same manner as in Example 1 is as follows.

Coating Temperature (25° C.)

Resin heat-molded and not subjected to dipping in solvent; $5\times10^7$ Pa·s

Resin heat-molded and subjected to dipping in solvent; $10^7$ Pa·s

Drying Temperature (80° C.)

Resin heat-molded and not subjected to dipping in solvent; $10^6$ Pa·s

Resin heat-molded and subjected to dipping in solvent; $5\times10^2$ Pa·s

Example 3

In C1000 PRESS manufactured by Fuji Xerox Co., Ltd., a toner image is formed using the developer 2 (toner 2) on an OPP film (20 μm thickness), and is heated with a roll to perform fixing.

The OPP film having the toner image formed thereon is set in a dry laminator (manufactured by Fuji Kikai Kogyo Co., Ltd., FL2), and 10 gsm of the coating agent 1 is applied using a gravure roll, and is then dried for 30 seconds with warm air of 80° C. to form an adhesive layer.

Next, a CPP film (30 μm thickness) is overlapped on the adhesive layer, and pressurized by a pair of rolls for laminate adhesion.

The laminate in which the CPP film is laminated on the toner image of the OPP film is taken out from the dry laminator, and is cured for 48 hours in an aging chamber in which the temperature is adjusted to 50° C.

The complex viscosity of the binder resin of the toner measured in the same manner as in Example 1 is as follows.

Coating Temperature (25° C.)

Resin heat-molded and not subjected to dipping in solvent; $10^7$ Pa·s

Resin heat-molded and subjected to dipping in solvent; $2\times10^6$ Pa·s

Drying Temperature (80° C.)

Resin heat-molded and not subjected to dipping in solvent; $2\times10^5$ Pa·s

Resin heat-molded and subjected to dipping in solvent; $2\times10^2$ Pa·s

Comparative Example 1

The coating agent 1 is sequentially applied, dried, and cured in the same manner as in Example 3, except that the image is formed using the toner 3.

The complex viscosity of the binder resin of the toner measured in the same manner as in Example 1 is as follows.

Coating Temperature (25° C.)

Resin heat-molded and not subjected to dipping in solvent; $10^7$ Pa·s

Resin heat-molded and subjected to dipping in solvent; $2\times10^6$ Pa·s

Drying Temperature (80° C.):

Resin heat-molded and not subjected to dipping in solvent; $2\times10^5$ Pa·s

Resin heat-molded and subjected to dipping in solvent; $2\times10^2$ Pa·s

Comparative Example 2

The coating agent 2 is sequentially applied, dried, and cured in the same manner as in Example 1, except that the image is formed using the toner 4.

The complex viscosity of the binder resin of the toner measured in the same manner as in Example 1 is as follows.

Coating Temperature (25° C.)

Resin heat-molded and not subjected to dipping in solvent; $2\times10^7$ Pa·s

Resin heat-molded and subjected to dipping in solvent; $5\times10^6$ Pa·s

Drying Temperature (80° C.)

Resin heat-molded and not subjected to dipping in solvent; $5\times10^3$ Pa·s

Resin heat-molded and subjected to dipping in solvent; $10^3$ Pa·s

Comparative Example 3

A toner image is formed on a polyester film in the same manner as in Example 1. Then, using a non-solvent laminator (manufactured by Fuji Kikai Kogyo Co., Ltd., FL2) as a lamination device, the coating agent 4 is applied to the toner image surface, a CPP film (30 μm thickness) is overlapped on and stuck to the adhesive layer (sticking temperature: 90° C.), and aging is performed in the same manner as in Example 1.

Evaluation Method

Measurement of Hydroxyl Value

The hydroxyl value is measured according to DIN 53 240-02. Approximately 2 g to 3 g of polyester is dissolved in dichloromethane or THF. 4-dimethylaminopyridine is used as a catalyst, and esterification is carried out at room temperature by acetic anhydride. After hydrolysis of the anhydrous compound which does not react, titration is performed with 0.5 N methanolic KOH.

Fixing Strength

In the example or the comparative example, a coating agent is applied to the fixed image, and the fixing strength of the fixed image after drying and aging is evaluated through a tape peel test. Specifically, an adhesive tape (manufactured by Nichiban Co., Ltd.: cellophane tape) having a width of 18 mm is stuck to the fixed image, and a columnar block is rolled on the adhesive tape in a circumferential direction to bring the tape into close contact with the image surface at a linear pressure of 300 g/cm. Thereafter, the adhesive tape is peeled, and the evaluation is performed according to the following criteria.

A: No defects are observed in the toner image.

B: Defects are observed with an area ratio of less than 10% in the toner image.

C: Defects are observed with an area ratio of 10% or greater in the toner image.

Adhesive Strength

In the examples or the comparative examples, a toner image printed material in which an unstretched polypropylene (CPP) film is stuck to the toner image surface is cut into a size of 15 mm width×75 mm length, and a T-type peel test is performed thereon using a tension tester to measure the peeling force of the CPP film. The peeling force is evaluated according to the following criteria to evaluate the adhesive strength.

A: 1.0 N/15 mm or greater

B: Greater than 0.5 N/15 mm and less than 1.0 N/15 mm

C: 0.5 N/15 mm or less

TABLE 1

| | Toner | | Coating Agent | | Complex Viscosity of Binder Resin (Pa · s) | | | |
|---|---|---|---|---|---|---|---|---|
| | | | | | Coating Temperature (25° C.) | | Drying Temperature (80° C.) | |
| | Kind | Binder Resin (hydroxyl value: mgKOH/g) | Kind | Solvent (SP value) | Resin A1 | After Dipping in Solvent B1 | Resin A2 | After Dipping in Solvent B2 |
| Example 1 | Toner 2 | Polyester Resin (50) | Coating Agent 2 | MEK (9.3) | $10^7$ | $2\times10^6$ | $2\times10^5$ | $10^2$ |
| Example 2 | Toner 1 | Polyester Resin (30) | Coating Agent 3 | Toluene (8.8) | $5\times10^7$ | $10^7$ | $10^6$ | $5\times10^2$ |
| Example 3 | Toner 2 | Polyester Resin (50) | Coating Agent 1 | Ethyl Acetate (9.0) | $10^7$ | $2\times10^6$ | $2\times10^5$ | $2\times10^2$ |
| Comparative Example 1 | Toner 3 | Polyester Resin (20) | Coating Agent 1 | Ethyl Acetate | $10^7$ | $2\times10^6$ | $2\times10^5$ | $2\times10^2$ |

TABLE 1-continued

| | | | | | | | | |
|---|---|---|---|---|---|---|---|---|
| Comparative Example 2 | Toner 4 | Styrene-Acrylic Resin (0) | Coating Agent 2 | (9.0) MEK (9.3) | $2 \times 10^7$ | $5 \times 10^6$ | $5 \times 10^5$ | $10^3$ |
| Comparative Example 3 | Toner 2 | Polyester Resin (50) | Coating Agent 4 | — | — | — | — | — |

| | Complex Viscosity Ratio (Pa · s) | | | | |
|---|---|---|---|---|---|
| | Coating Temperature (25° C.) A1/B1 | Drying Temperature (80° C.) A2/B2 | Lamination Sticking Base | Evaluation Fixing Strength | Evaluation Adhesive Strength |
| Example 1 | 5 | $2 \times 10^3$ | — | A | — |
| Example 2 | 5 | $2 \times 10^3$ | — | A | |
| Example 3 | 5 | $10^3$ | CPP | — | A |
| Comparative Example 1 | 5 | $10^3$ | CPP | — | C |
| Comparative Example 2 | 4 | $5 \times 10^2$ | CPP | C | — |
| Comparative Example 3 | — | — | CPP | — | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method of preparing a toner image printed material, comprising:

forming a toner image on a recording medium;

forming a coating film by applying a coating liquid onto a surface having the toner image of the recording medium; and drying the coating film, wherein the toner image contains, as a binder resin, a polyester resin having a hydroxyl value of 25 mg KOH/g or higher, and the coating liquid contains a solvent component that swells or dissolves the polyester resin, a polyisocyanate component, and a polyol component.

2. The method of preparing a toner image printed material according to claim 1, further comprising:

aging the recording medium at a temperature in a range of from 40° C. to 60° C. after the drying.

3. The method of preparing a toner image printed material according to claim 1, wherein the solvent component has a solubility parameter (SP value) in a range of from 8.5 to 10.0.

4. The method of preparing a toner image printed material according to claim 1, wherein the solvent component is a solvent that promotes plasticization of the polyester resin at a temperature of the drying rather than at a temperature of the coating.

5. The method of preparing a toner image printed material according to claim 1, wherein a complex viscosity of the polyester resin at a temperature of the coating A1 (Pa·s), a complex viscosity of the polyester resin dipped in the solvent component at the temperature of the coating B1 (Pa·s), a complex viscosity of the polyester resin at a temperature of the drying A2 (Pa·s), and a complex viscosity of the polyester resin dipped in the solvent component at the temperature of the drying B2 (Pa·s) satisfy the following expressions (1) and (2):

$$A1/B1<10; \quad (1)$$

and $$A2/B2 \geq 100. \quad (2)$$

6. The method of preparing a toner image printed material according to claim 1, further comprising:

sticking a sticking base to the recording medium via the dried coating film.

7. The method of preparing a toner image printed material according to claim 1, wherein the drying is a process of blowing warm air having a temperature in a range of from 50° C. to 100° C. to the coating film.

8. The method of preparing a toner image printed material according to claim 1, wherein the recording medium is a thermoplastic resin film having a thickness of from 10 μm to 30 μm.

* * * * *